US005243896A

United States Patent [19]

Rodriguez

[11] Patent Number: 5,243,896

[45] Date of Patent: Sep. 14, 1993

[54] LOGISTICAL SUPPORT APPARATUS FOR WEAPONS VEHICLES

[75] Inventor: Derek A. Rodriguez, Milton, Vt.

[73] Assignee: General Electric Company, Burlington, Vt.

[21] Appl. No.: 812,536

[22] Filed: Dec. 23, 1991

[51] Int. Cl.[5] ..... F41A 9/87

[52] U.S. Cl. ..... 89/40.07

[58] Field of Search ..... 89/36.08, 40.07, 46

[56] References Cited

U.S. PATENT DOCUMENTS

| | | | |
|---|---|---|---|
| H297 | 7/1987 | Schultz | 244/135 A |
| 3,402,805 | 9/1968 | Spellman, Jr. | 198/139 |
| 4,236,441 | 12/1980 | Turner et al. | 89/40.07 |
| 4,557,367 | 12/1985 | Kulp | 198/313 |
| 4,648,305 | 3/1987 | Elspass | 89/36.08 |
| 5,103,712 | 4/1992 | Minovitch | 89/40.07 |

*Primary Examiner*—Stephen C. Bentley
*Attorney, Agent, or Firm*—Stephen A. Young

[57] ABSTRACT

To resupply a weapons vehicle, a resupply vehicle carries a docking boom which is maneuvered into a docking position to mate a docking head at its free end with a docking port on the weapons vehicle. The weapons vehicle is resupplied with ammunition and fuel through the docking boom. A wire communications link between the vehicles is also established through the boom. The boom docking and resupply operations are remotely controlled from within the resupply vehicle.

21 Claims, 7 Drawing Sheets

LOGISTICAL SUPPORT APPARATUS FOR WEAPONS VEHICLES

The present invention relates to the logistical support of mobile weapons systems and particularly to resupplying weapons vehicles in the field.

BACKGROUND OF THE INVENTION

Presently, the resupply of military fighting vehicles, such as tanks and self-propelled howitzers, in the field is time-consuming, highly labor intensive and hazardous to personnel. It will be appreciated that resupplying such a vehicle involves not only rearming its weapons system, but refueling the vehicle as well. Also, there may be a need to exchange information while the resupply procedure is ongoing.

Currently, to rearm a mobile weapons system, an ammunition supply vehicle and the tank or self-propelled howitzer rendezvous in the field, and ammunition is unloaded from the former and loaded into the latter. The crew must dismount their vehicles to participate in the transfer of ammunition rounds and thus may be exposed to hostile fire. While conveyors are available to expedite ammunition transfer and to reduce crew exposure, initial positioning of the conveyor is still required by personnel external to the vehicles. Refueling the weapons vehicle then involves a separate rendezvous with a tanker vehicle, and a crew member must dismount to connect up a fuel hose. It will be appreciated that, while these resupply operations are in progress, the weapons vehicle is essentially out of action and especially vulnerable, as are the resupply vehicles.

SUMMARY OF THE INVENTION

It is accordingly an objective of the present invention to provide a resupply vehicle that is equipped to rearm and refuel a weapons vehicle on a concurrent and expedited basis without crew members having to leave the protective confines of their vehicles. In addition, the present invention also provides for the establishment a secure wire communications link between the two vehicles enabling the respective crews to exchange information.

To achieve these objectives in accordance with the present invention, a resupply vehicle is equipped with an armored docking boom enclosing an ammunition conveyor, one or more fluid resupply lines, and one or more communication lines. The docketing boom includes a shoulder section mounted to the resupply vehicle for rotation in azimuth, an extensible section mounted at one end to the shoulder for pivotal movement in elevation, and a transition section connected to the other end of the extensible section by a universal joint for movement in both azimuth and elevation. Actuators independently articulate the boom sections relative to each other to mate a compliant docking head, mounted at the free end of the transition section, with a docking port of the weapons vehicle. The docking head includes a video camera enabling a docking operator to visually control the docking maneuver from the protective confines of the resupply vehicle. Once the docking head is mated with and latched to the docking port, fluid couplings are effected at the docking interface to accommodate refueling of the weapons vehicle and the resupply of liquid propellant (LP) if the vehicle weapons system includes an LP gun. Also, electrical couplings are effected at the docking interface to accommodate wire communications between the vehicles. While fluids resupply is ongoing, projectiles or cartridge ammunition rounds are transferred from the resupply vehicle to the weapons vehicle via the ammunition conveyor.

The invention accordingly comprises the features of construction, combination of elements, and arrangement of parts, all as described hereinafter, and the scope of the invention will be indicated in the claims.

BRIEF DESCRIPTION OF THE DRAWINGS

For a full understanding of the nature and objects of the invention, reference may be had to the following Detailed Description taken in conjunction with the accompanying drawings, in which.

Corresponding reference numerals refer to like parts throughout the several views of the drawings.

DETAILED DESCRIPTION

Figure 1:
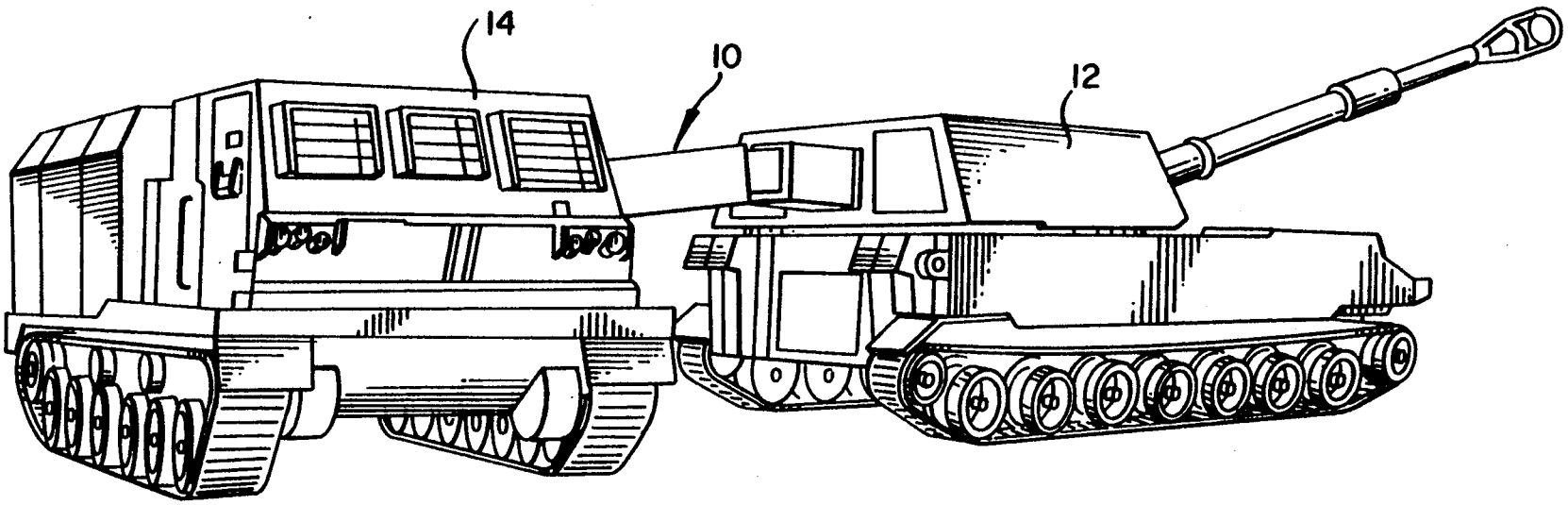
FIG. 1 is a perspective view of a weapons vehicle being resupplied from a resupply vehicle via a docking boom constructed in accordance with the present invention.
Figure 2:
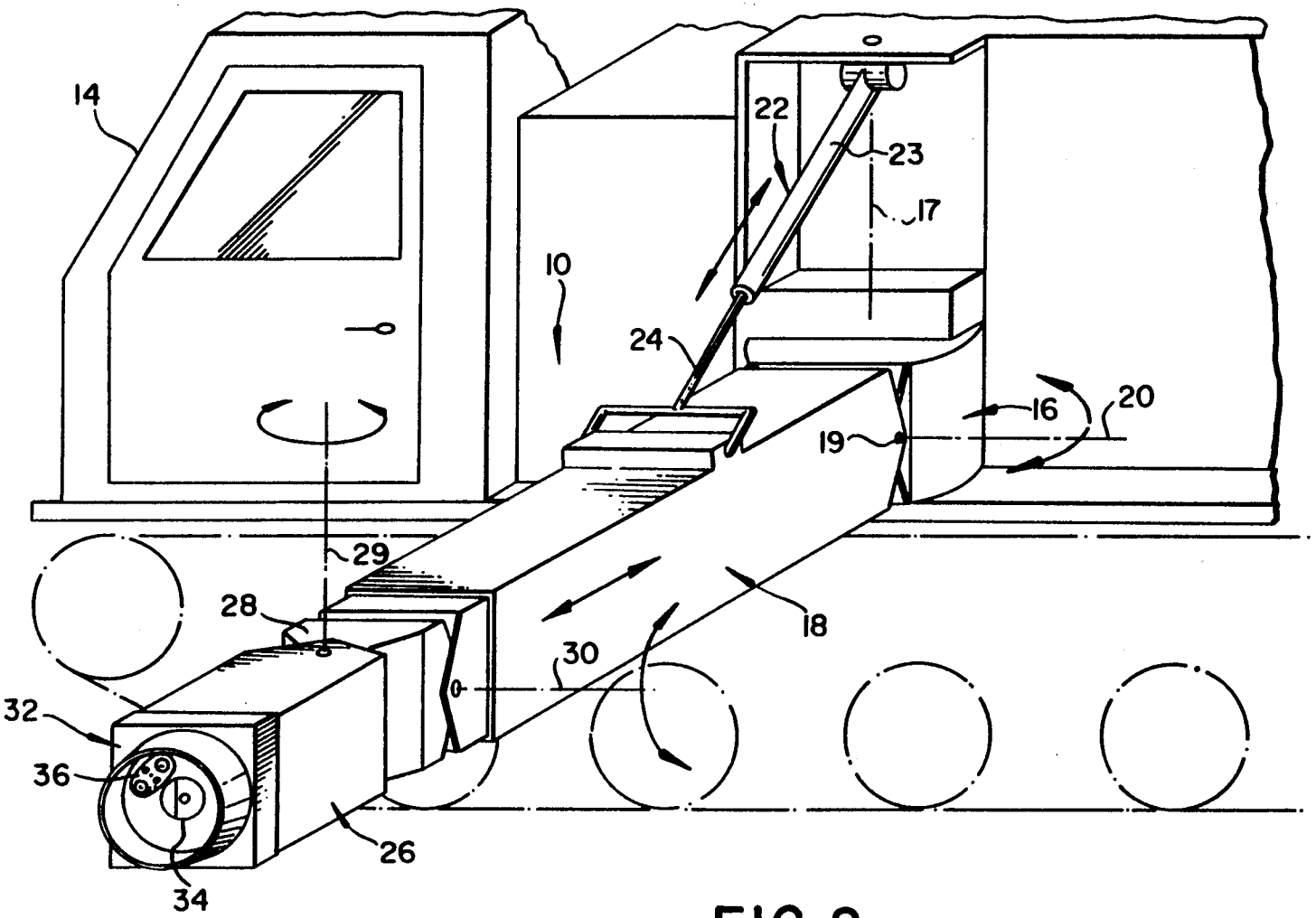
FIG. 2 is an enlarged perspective view of the docking boom of FIG. 1.
Figure 3:
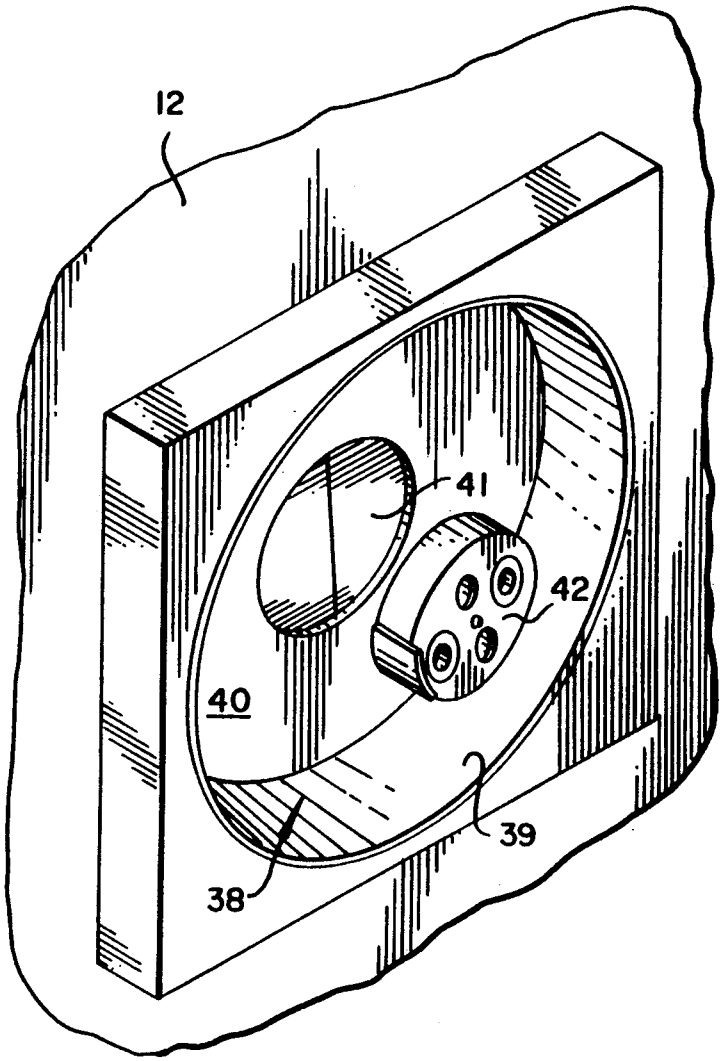
FIG. 3 is a perspective view of a docking port on the weapons vehicle, which mates with a docketing head at the free end of the docking boom of FIG. 2.
Figure 4:
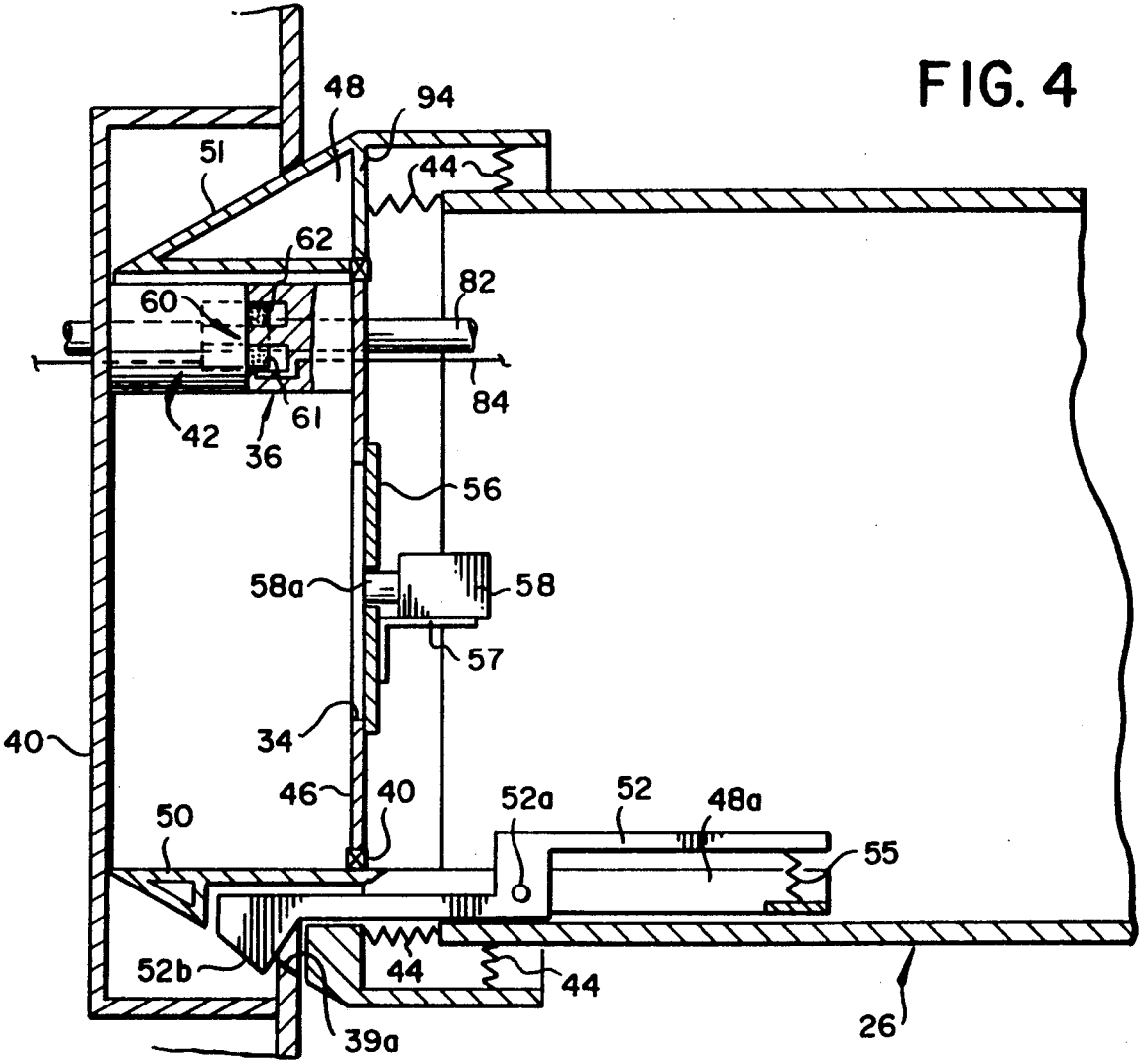
FIG. 4, is a fragmentary, longitudinal sectional view of the docking head portion of the docking boom of FIG. 2.

The docking boom of the present invention, generally indicated at 10, is illustrated in FIG. 1 in a docked position to resupply a weapons vehicle 12, such as a self-propelled horwitzer, from a resupply vehicle 14. As seen in FIG. 2, docking boom 10 includes a shoulder section, generally indicated at 16 and mounted to one side of resupply vehicle 14 for rotational movement in azimuth about a vertical axis 17. An extensible boom section, generally indicated at 18, is pivotally mounted to the shoulder section by opposed side pins, one indicated at 19, for relative movement in elevation about a horizontal axis 20 motivated by linear hydraulic actuator 22 having its cylinder 23 pivotally connected to the resupply vehicle and its plunger 29 pivotally connected to the extensible section. A transition boom section, generally indicated at 26 is, connected to the distal end of extensible boom section 18 by a universal joint, generally indicated at 28, to accommodate limited pivotal motion of the transition section relative to the extensible section in azimuth about vertical axis 29 and in elevation about horizontal axis 30. The other actuators for articulating the docking boom sections are described below in conjunction with FIG. 5. Completing the general description of docking boom 10 seen in FIG. 2, a docking head, generally indicated at 32 is mounted to the distal end of the transition section. As described below, the docking head is equipped with a shuttered ammunition port 34 and a coupler pad 36 incorporating fluid and electrical couplings. The docking head 32 is configured to mate with a docking port, generally indicated at 38 in FIG. 3, which is provided on weapons vehicle 12. This docking port is defined by a circular opening 39 in the weapons vehicle armor plating and a recessed backwall 40 in which is formed a shuttered ammunition port 41. A raised coupler pad 42 protrudes forwardly from the backwall. When the docking head of the docking boom is mated with the docking port of the weapons vehicle as seen in FIG. 4, their ammunition ports 34 and 41, respectively, are aligned to accommodate ammunition resupply when their shutters are opened. Also, when the docking head coupler pad 36 and the docking port coupler pad 42 are aligned and their various couplings made, fluids resupply and communications exchange are enabled.

As seen in FIG. 4, docking head 32 is compliantly mounted to transition boom section 26 by sets of distributed springs 44 to accommodate minor misalignments of the docking head with the docking port 38 during the docking procedure. The docking head includes a recessed backwall 46 which is rotatably mounted to a docking cone 48 by an annular roller bearing set 49. The docking cone is formed having a cylindrical bore 50 closed off by backwall 46 and a conical outer surface 51. When the docking head is mated with the docking port, the conical surface 51 of the docking cone is centered in the docking port by the bevelled edge **39*a* of its opening 39. This mated relationship is retained by a plurality of angularly spaced latches, one seen at 52 in FIG. 4. Each latch is pivotally mounted to an extension 48*a* of the docking cone by a pin 52*a* and is biased by a spring 55 into engagement with the inner side of the armor plating bordering opening 39 when the docking head is fully mated with the docking port. The sloping latch surfaces 52*b* of the latches 52** permit undocking when the resupply procedure is completed, simply by forcibly withdrawing the docking head.

Still referring to FIG. 4, a primary shutter 56 for ammunition port 34 of the docking head is fitted with a bracket 57 to support a video camera 58 in position to view the docking operation through a peephole **58*a* aligned with the docking head centerline. A video monitor (not shown) displays the camera image to a docking operator as an aid to remotely controlling the docking operation. Also shown in FIG. 4 is a suitable electrical coupler, generally indicated at 60, incorporated in coupler pad 36. This coupler, which includes a wire bobbin 61 embracing the center leg of an E-core 62, becomes inductively coupled with a like coupler incorporated in the docking port coupler pad 42 (FIG. 3**) when docking is completed. This inductive transformer coupling completes a wire communications link for the exchange of information between vehicle crews, which is secure and not susceptible to detection by the enemy.

Figure 5:
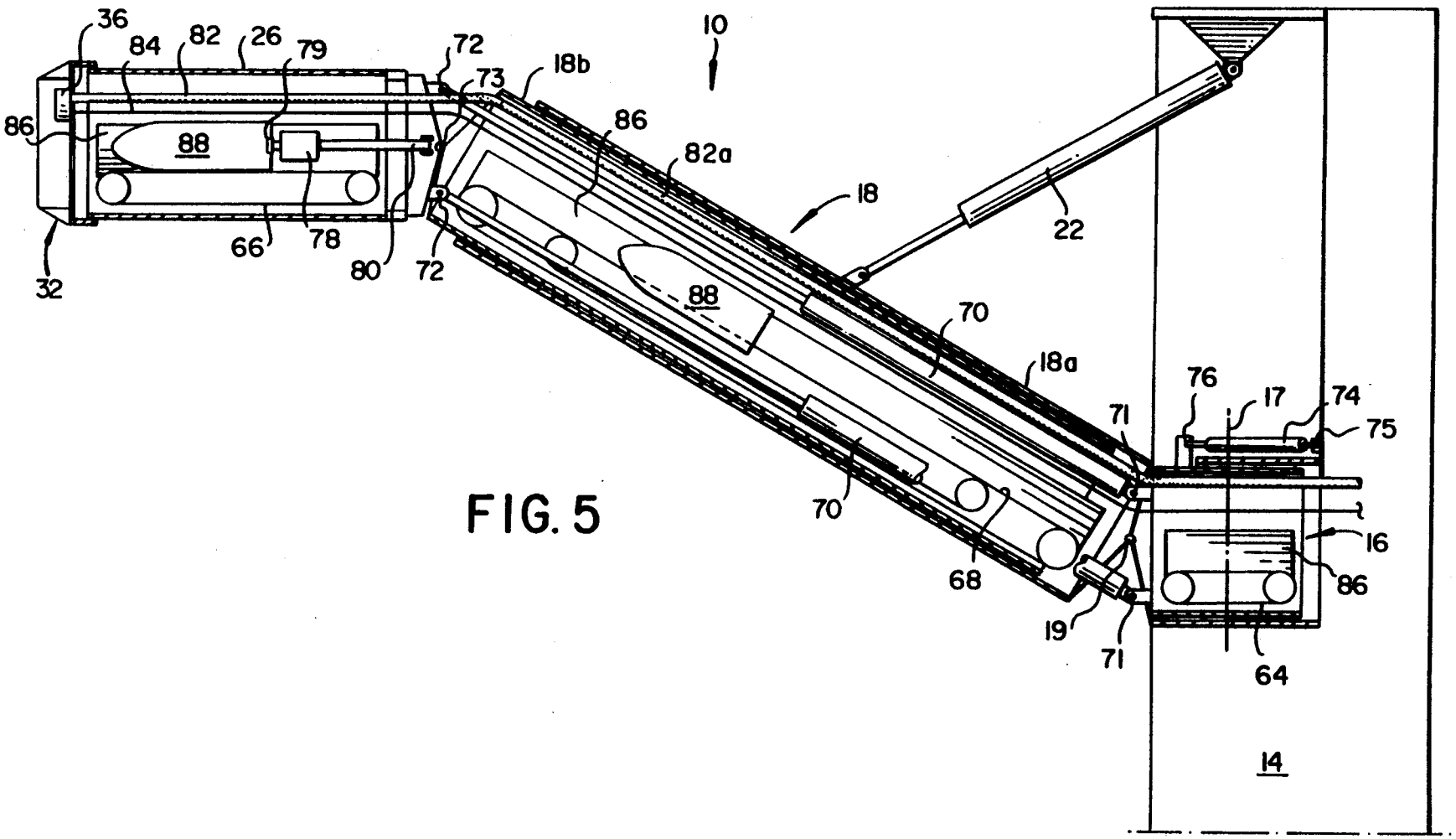
FIG. 5 is a longitudinal sectional view of the docking boom of FIG. 2.

As seen in the sectional view of FIG. 5, shoulder boom section 16 contains a short conveyor 64, transition boom section 26 contains another short belt conveyor 66, and extensible boom section 18 contains an extensible conveyor 68, which may be of the construction disclosed in the commonly assigned, Bender-Zanoni et al. copending application Ser. No. 07/633,555, filed Dec. 24, 1990, now U.S. Pat. No. 5,074,402.The two telescoping sections of the extensible conveyor are respectively mounted to protective, telescoping rectangular housing sections **18*a* and 18*b* of the extensible boom section. Outer housing section 18*a* is pivotally connected at its resupply vehicle end to shoulder boom section 16 at 19 for elevational positioning of the docking boom by actuator 22, as described above, while the free end of inner housing section 18*b* is pivotally connected at 73 to universal joint 28. Concomitant adjustments of the extensible boom section and extensible conveyor lengths to span the separation between vehicles is motivated by a pair of upper and lower linear hydraulic actuators 70 which are pivotally connected at their plunger ends to the shoulder boom section, as indicated at 71, and pivotally connected at their plunger ends to universal joint 28, as indicated at 72. It is seen that uniform activation of actuators 70 is effective to adjust the boom and conveyor lengths, while differential activation swings transition boom section 26 relative to the extensible boom section in elevation about horizontal axis 30 (FIG. 2). It will also be noted that, by virtue of the pivotal connections 71 and 72 of the ends of actuators 70 to the shoulder boom section and universal joint, respectively, a parallelogram or four-bar linkage between the shoulder boom section and the transition boom section is created. Thus, with actuators 70 de-activated, changes in elevation of the extensible boom section imposed by actuator 22 do not change that altitude of the transition boom section relative to the shoulder boom section. That is, when the linear actuators 70** are in length conditions, the transition boom section remains parallel to the shoulder boom section (and typically also ground) as the extensible boom section swings in elevation. This feature greatly facilitates docking maneuvers.

Still referring to FIG. 5, a linear actuator 74 is pivotally connected at its plunger end to resupply vehicle 14, as indicated at 75, and at its plunger end to shoulder boom section 16, as indicated at 76, to motivate positioning of the docking boom in azimuth about vertical axis 17 during a docking maneuver and to swing the docking boom into a stowed position in close parallel relation to the side of the resupply vehicle. Another linear actuator 78 is pivotally connected at its plunger end to the transition boom section, as indicated at 79, and at its plunger end to the universal joint, as indicated at 80. Activation of this actuator swings the transition boom section relative to the extensible boom section in azimuth about vertical axis 29 (FIG. 2). It is seen that controlled activation of these actuators by the docking operator is effective to adjust the length of the docking boom and to articulate its sections in azimuth and elevation so as to accommodate docking without having to precisely relatively position the weapons and resupply vehicles. This is so even in the case of uneven terrain, where the two vehicles are at different elevations and different pitch and roll altitudes.

As also seen in FIG. 5, at least one hose 82 runs from coupler pad 36 in docking head 32 through the docking boom sections and into the supply vehicle. Extension of the hose length with extension of the docking boom may be accommodated by feeding hose from a slack loop or reel within the resupply vehicle or, alternatively, by incorporating a telescopic fluid joint **82*a* in the segment of the hose extending through the extensible boom section. Preferably, two hoses extend through the docking boom, one for refueling and the other for the resupply of liquid propellant. Also extending through the docking boom from the coupler pad are electrical lines 84 to provide the communications link between the vehicles. Also illustrated in FIG. 5 are upwardly extending and outwardly flared guides 86 mounted coextensively with the sides of each of the conveyors 64, 66 and 68 to provide lateral control of projectiles 88** while being conveyed on the upper runs of the conveyors and to ensure successful transitions from conveyor to conveyor.

Once the docking head is mated with and latched to the docking port, the coupler pad 36 of the former needs to be precisely aligned with the coupler pad 42 of the latter. To this end, coupler pad 36 is mounted to backwall 46 at the same radial position relative to the docking head axis as coupler pad 42 is mounted to backwall 42 relative to the docking port axis. When the docking port and docking head are mated and latched, their axes are coincident, thus coupler pad alignment can be achieved by adjusting the angular position of the docking head coupler pad. To achieve coupler pad alignment, an angular alignment mechanism, generally indicated at 90 in FIG. 6, includes a linear electric actuator 92 pivotally connected at its plunger end to a post 93 outstanding from a collar 94 of the docking cone 48 (FIG. 4), which serves to rotatably mount the docking cone backwall 46. The plunger end of actuator 92 is pivotally connected to an actuator link 96 which, in turn, is pivotally connected to a post 97 outstanding from backwall 46. A laterally extending arm 96*a* of the actuator link projects between a pair of cam followers 98 carried by an alignment pin 99 slidingly mounted in a bore in backwall 46 for extension through docking head coupler pad 36. A compression spring 100 biases the alignment pin rearwardly to a retracted position. A push plate 101 is pinned to the alignment pin and is linked to a coupling holder 102 which carries a pair of valved, unisex fluid couplings 104 which may be of the type available from Aeroquip Corporation of Jackson, Mich. The push plate is provided with clearance openings 105 through which the fluid couplings project.

When actuator 92 is activated to retract its plunger, it is seen that actuator link 96 is pulled leftward, causing backwall 46 to rotate in the clockwise direction indicated by arrow 92*a*. Coupler pad 36 is thus revolved in the clockwise direction. Spring 100 preloads the actuator link via cam follower 98 such that actuator arm 96*a* remains in the illustrated orientation during this coupler pad alignment step. When coupler pad 36 revolves to a point where it engages an alignment stop 42*a* outstanding from the docking port coupler pad 42, coupler pad alignment is achieved. With backwall 46 now stopped from further rotation, continued activation of actuator 92 causes activator arm 96*a* to duck forwardly (arrow 96*b*), compressing spring 100 and driving alignment pin 99 forwardly into an alignment hole 42*b* in coupler pad 42. In the process, the alignment pin drives push plate 101 and coupling holder 102 forwardly to advance fluid couplings 104 of coupler pad 36 into coupling relation with fluid couplings 106 of the docking port coupler pad 42.

Figure 7:
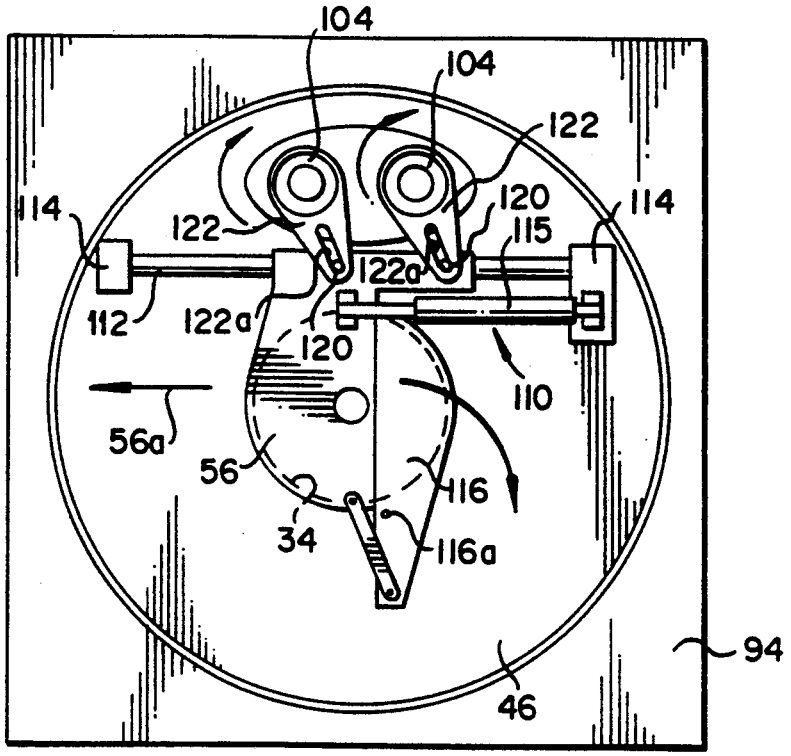
FIG. 7 is an elevational view of shutter operating and fluid coupling actuating mechanism carried by the docking head.

With the fluid coupling in coupling relation, their connections must now be made. Turning to FIG. 7, an operating mechanism, generally indicated at 110, is provided to effect the fluid coupling connections and also to unshutter docking head ammunition port 34 (FIG. 4). As seen in FIG. 7, primary shutter 56 is slidingly mounted by a rod 112 affixed to backwall 46 by end brackets 114. A linear electric actuator 115 is connected at its cylinder end to one of the rod brackets and at its plunger end to the primary shutter. A secondary shutter 116 is pivotally mounted at 116*a* to backwall 46 and is connected to the primary shutter by a pivot link 118. From this description, it is seen that when actuator 115 is activated to extend its plunger, primary shutter 56 is slid leftward (arrow 56*a*) and secondary shutter is pivoted in the clockwise direction to unshutter ammunition port 34 preparatory to ammunition resupply.

As also seen in FIG. 7, primary shutter 56 carries a pair of pins 120 which operate in elongated slots 122*a* provided in coupling cranks 122 for couplings 104. Thus, while the primary shutter is moved aside by actuator 115, the coupling cranks are swung in the clockwise direction to make fluid-tight connections between the docking head couplings 104 and the docking port couplings 106.

Figure 6:
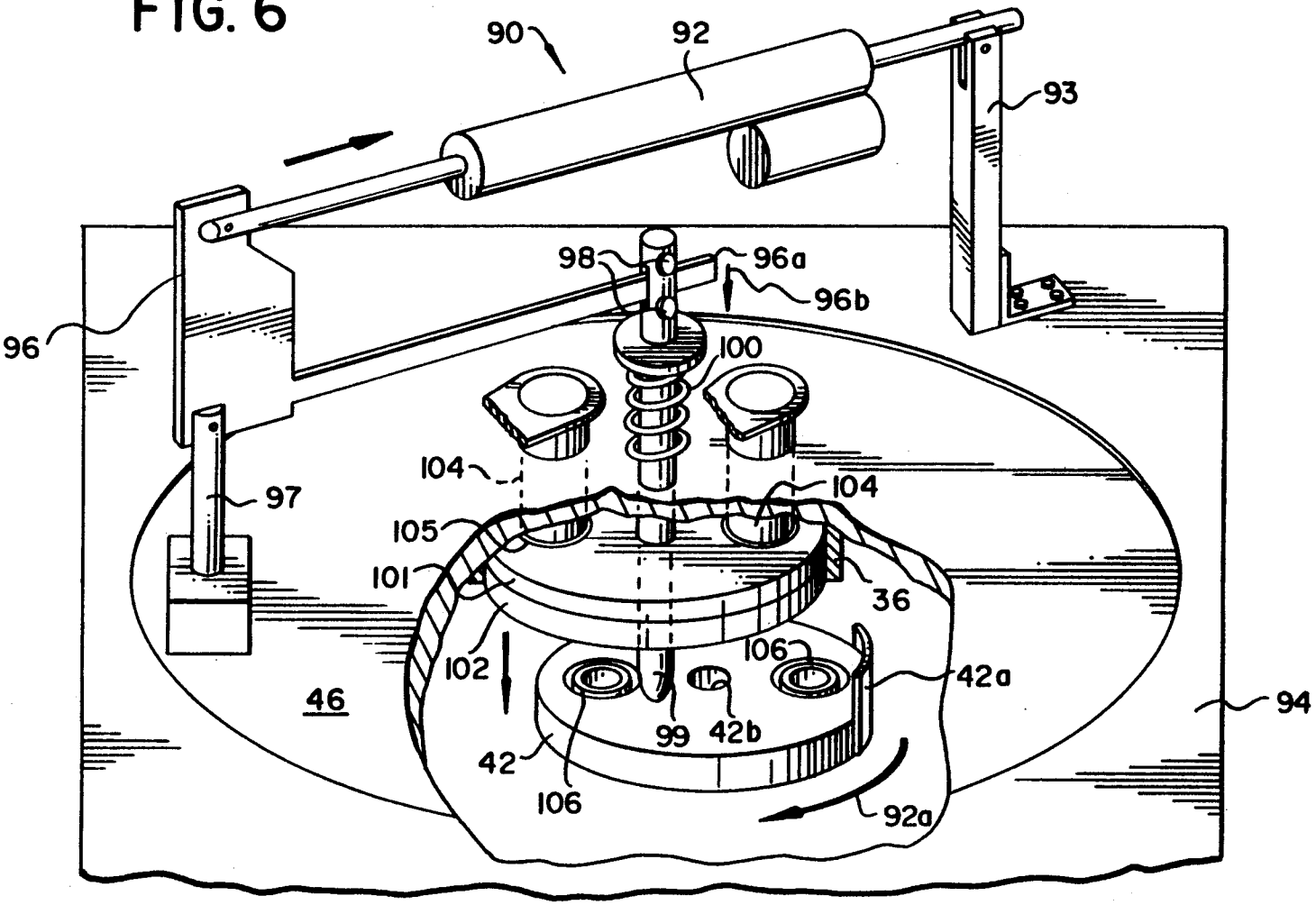
FIG. 6 is a perspective view of a fluid coupling alignment mechanism carried by the docking head.
Figure 8:
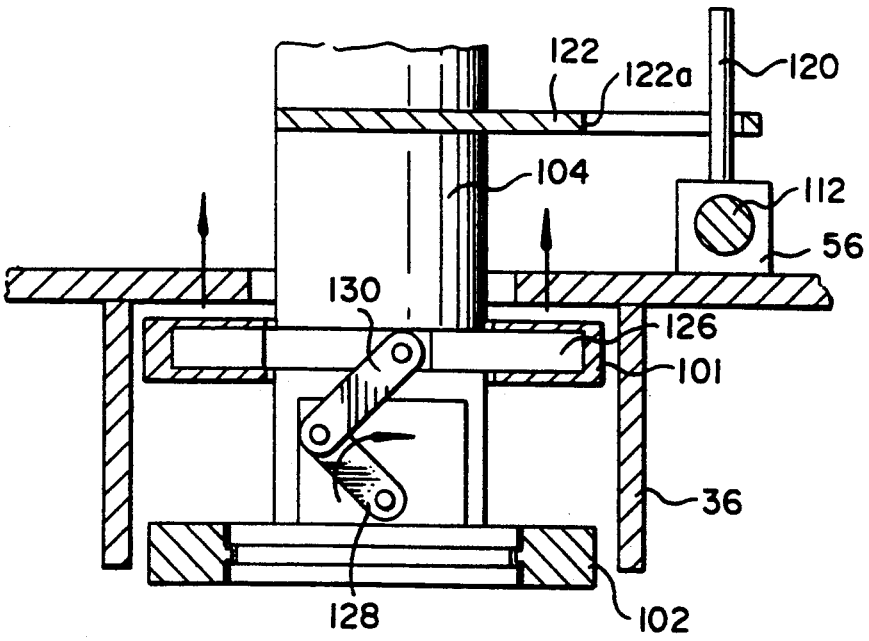
FIG. 8 is a side view illustrating elements of the mechanisms of FIGS. 6 and 7 for operating fluid coupling valves.

The final step preparatory to the resupply of fuel and liquid propellant is to open the valves of docking head couplings 104. This step is illustrated in FIG. 8. Once the fluid connections of the couplings have been made by operating mechanism 110 of FIG. 7, coupling alignment actuator 92 of FIG. 6 is activated in the reverse direction. Compression spring 100 is then released to retract alignment pin 99 and push plate 101 pinned thereto. Since the fluid coupling connections have been made, couplings 104 and coupling holder 102 remain in their advanced positions seen in FIG. 8. A separate collar 126, embracing each fluid coupling 104, is rotatably mounted by push plate 101 to accommodate coupling rotation incident to making the coupling connections by operating mechanism 110. A valve activating lever 128 for each fluid coupling is then connected to its associated collar 126 by a pivot link 130. When push plate 101 and coupling holder 102 are juxtaposed, as seen in FIG. 6, valve actuating levers 128 are forced to their counter clockwise-most positions, closing the valves of fluid couplings 104. Then when push plate 101 is retracted by spring 100 upon reverse activation of actuator 92, leaving the fluid couplings and coupling holder in their advanced positions, valve actuating levers 128 are swung in the clockwise direction to open the coupling valves and thus enable the flow of fuel and liquid propellant to the weapons vehicle.

From the foregoing Detailed Description, it is seen that the present invention provides a docking boom borne by a resupply vehicle, which can be readily maneuvered into docking position with a weapons vehicle and through which the weapons vehicle is expeditiously resupplied with fuel, ammunition, and information. The entire docking and resupply procedure is remotely controlled from the protective confines of the resupply vehicle, and thus crew members need not be exposed to hostile fire. The objectives of the invention set forth above have thus been efficiently achieved. However, since certain changes may be made in the construction set forth above without departing from the scope of the invention, it is intended that matters of detail be taken as illustrative and not in a limiting sense.

Having described the invention, what is claimed as new and desired to secure by Letter Patent is:

1. Apparatus for adaption to a resupply vehicle to resupply a weapons vehicle, said apparatus comprising, in combination:

A. a docking port provided on the weapons vehicle;

B. a docking boom having one end mounted to the resupply vehicle and a free end;

C. a docking head mounted to said free end of said docking boom and configured to mate with said docking port;

D. remotely controllable actuating means for maneuvering said docking boom into a docking position with said docking head into mating relation with said docking port;

E. an ammunition conveyor mounted by said docking boom for conveying ammunition from the resupply vehicle to the weapons vehicle through said docking port; and F. fluid resupply means including a first fluid coupling positioned in said docking port, a second fluid coupling positioned in said docking head, and a resupply hose extending along said docking boom from said second fluid coupling to the resupply vehicle, said first and second fluid couplings being in fluid coupled relation when said docking head and docketing port are in mating relation to convey a fluid from the resupply vehicle to the weapons vehicle.

2. The apparatus defined in claim 1, which further includes a video camera positioned in said docking head to provide visual guidance while maneuvering said docking boom into said docking position.

3. The apparatus defined in claim 1, wherein said docking boom includes enclosing structure through which said ammunition conveyor and resupply hose extend.

4. The apparatus defined in claim 3, which further comprises a communications link including a first electrical coupler positioned in said docking port, a second electrical coupler positioned in said docking head, and a wire link extending from the resupply vehicle through said docking boom enclosing structure to said second electrical coupler, said first and second electrical couplers being in electrically coupled relation when said docking head and said docking port are in mating relation to support communications exchange between the resupply and weapons vehicles.

5. The apparatus defined in claim 4, wherein said first and second electrical couplers are inductive couplers.

6. The apparatus defined in claim 1, wherein said one end of said docking boom is pivotally mounted to the resupply vehicle for swinging movement in azimuth for deployment from a stowed position against the resupply vehicle.

7. The apparatus defined in claim 6, wherein said docking boom includes an extensible section powered by said actuating means to vary the length of said docking boom.

8. The apparatus defined in claim 7, which includes multiple said fluid resupply means for separately conveying fuel and liquid propellant to the weapons vehicle.

9. The apparatus defined in claim 7, wherein said docking head includes an ammunition port aligned with the exit end of said ammunition conveyor, a shutter mounted for movement between a closed position blocking said ammunition port and an open position clear of said ammunition port, and a video camera mounted by said shutter in position to view said docking port through said ammunition port and a peephole in said shutter.

10. The apparatus defined in claim 7, wherein said docking port includes a first coupler pad incorporating said first fluid coupling, and said docking head includes a conical docking cone for nesting with a frontal opening of said docking port when said docking head and docking port are in mating relation, a rotatably mounted backwall for carrying a second coupler pad incorporating said second fluid coupler, and a first remotely controlled actuator for rotating said backwall to align said second coupler pad with said first coupler pad and then advancing said second coupler pad toward said first coupler pad to move said second coupling into fluid coupling relation with said first coupler while said docking head and docking port are in mating relation.

11. The apparatus defined in claim 10, wherein said docking port includes an alignment stop positioned to arrest rotating motion of said backwall when said second coupler pad achieves alignment with said first coupler pad and then to induce advancement of said second coupling into fluid coupling relation with said first coupling.

12. The apparatus defined in claim 11, wherein said docking head further includes a second remotely controlled actuator for rotating said second coupling into fluid-tight connection with said first coupling.

13. The apparatus defined in claim 12, wherein said docking head further includes valve operating means for opening said second coupling to fluid flow upon completing said fluid-tight connection with said second coupling.

14. The apparatus defined in claim 10, wherein said first coupler pad further incorporates a first electrical coupler, and said second coupler pad further incorporates a second electrical coupler, said second electrical coupler being advanced into electrical coupling relation with said first electrical coupling concomitantly with the advancement of said second coupling into fluid coupling relation with said first coupling.

15. Apparatus for adaption to a resupply vehicle to resupply a weapons vehicle, said apparatus comprising, in combination:

A. docking port provided on the weapons vehicle;

B. a docking boom including 1) a shoulder section mounted to the resupply vehicle for pivotal movement in azimuth, 2) an extensible section having a first end and a second end, said first end connected to said shoulder section for swinging motion of said extensible section in elevation, 3) a transition section having first and second ends, 4) a universal joint connecting said first end of said transition section to said second end of said extensible section for swinging motion of said transition section in both azimuth and elevation;

C. a docking head compliantly mounted to said second end of said transition section;

D. separate remotely controlled actuators for selectively rotating said shoulder section in azimuth, selectively swinging said extensible section in elevation, selectively varying the length of said extensible section, and selectively swinging said transition section in azimuth and elevation to maneuver said docking boom into a docking position with said docking head in mating relation with said docking port; and E. conveyor means extending through said shoulder, extensible and transition sections of said docking boom for conveying ammunition from the resupply vehicle to the weapons vehicle through said docking port.

16. The apparatus defined in claim 15, wherein said extensible section includes a pair of said actuators of a linear actuator type having opposed ends pivotally connected to said shoulder section and said universal joint to provide a parallelogram linkage between said transition and shoulder sections, whereby, equal activations of said pair of linear actuators vary the length of said extensible section, unequal activations of said pair of linear actuators swing said transition section in elevation, and, with said pair of linear actuators de-activated, the attitude of said transition section relative to said shoulder section remains unchanged as said extensible section swings in elevation.

17. The apparatus defined in claim 15, wherein said conveyor means includes a first conveyor section for conveying ammunition through said shoulder boom section, a second conveyor section for conveying ammunition from said first conveyor section through said extensible boom section, and a third conveyor section for conveying ammunition from said second conveyor section through said transition boom section, said second conveyor section being an extensible conveyor section whose length is varied concomitantly with variations in the length of said extensible boom section by at least one of said actuators.

18. The apparatus defined in claim 17, which further comprises fluid supply means including a first fluid coupling located in said docking port, a second fluid coupling located in said docking head, and a resupply hose extending through said docking boom from said second fluid coupling to the resupply vehicle, said first and second fluid couplings being in fluid coupling relation when said docking head and docking port are in mated relation.

19. The apparatus defined in claim 18, which further comprises a communications link including a first electrical coupler positioned in said docking port, a second electrical coupler positioned in said docking head, and a wire link extending from the resupply vehicle through said docking boom sections to said second electrical coupler, said first and second electrical couplers being in electrically coupled relation when said docking head and said docking port are in mated relation to support communications exchange between the resupply and weapons vehicles.

20. The apparatus defined in claim 18, wherein said docking head includes an ammunition port aligned with said third conveyor section, a shutter mounted for movement between a closed position blocking said ammunition port and an open position clear of said ammunition port, and a video camera mounted by said shutter in position to view said docking port through said ammunition port and a peephole in said shutter.

21. The apparatus defined in claim 18, wherein said docking port includes a first coupler pad incorporating said first fluid coupling, and said docking head includes a conical docking cone for nesting with a frontal opening of said docking port when said docking head and docking port are in mated relation, a rotatably mounted backwall for carrying a second coupler pad incorporating said second fluid coupler, and another one of said actuators for rotating said backwall to align said second coupler pad with said first coupler pad and then advancing said second coupler pad toward said first coupler pad to move said second coupling into fluid coupling relation with said first coupler while said docking head and docking port are in mated relation.

* * * * *